US007175066B2

(12) United States Patent
Varanasi

(10) Patent No.: US 7,175,066 B2
(45) Date of Patent: Feb. 13, 2007

(54) SHIPPING AND DISPLAY CARTON

(75) Inventor: Aditya Varanasi, Plano, TX (US)

(73) Assignee: Frito-Lay North America, Inc., Plano, TX (US)

( * ) Notice: Subject to any disclaimer, the term of this patent is extended or adjusted under 35 U.S.C. 154(b) by 157 days.

(21) Appl. No.: 10/653,742

(22) Filed: Sep. 2, 2003

(65) Prior Publication Data

US 2005/0045706 A1 Mar. 3, 2005

(51) Int. Cl.
*B65D 17/28* (2006.01)
*B65D 25/54* (2006.01)

(52) U.S. Cl. ..... 229/235; 229/162.6; 229/237; 229/240

(58) Field of Classification Search ..... 229/162.6, 229/235, 236, 237, 240, 242, 243, 244; 206/427, 206/429, 736, 769
See application file for complete search history.

(56) References Cited

U.S. PATENT DOCUMENTS 1,864,968 A * 6/1932 Weiner ..... 229/240
2,152,079 A 3/1939 Mott
2,457,291 A 12/1948 Wenzel
3,111,255 A 11/1963 Skowronski
3,139,979 A 7/1964 Russell
3,315,875 A 4/1967 Praetorius
3,324,999 A * 6/1967 Farquhar ..... 229/243
3,347,356 A 10/1967 Kossnar
3,355,089 A * 11/1967 Champlin ..... 229/237
3,542,192 A * 11/1970 Steck ..... 206/427
3,653,495 A 4/1972 Gray
3,829,006 A * 8/1974 Spiegel ..... 229/242
4,000,811 A 1/1977 Hardison
4,008,849 A * 2/1977 Baber ..... 229/237
4,053,101 A 10/1977 Hart
4,058,206 A 11/1977 Morse et al.
4,113,100 A * 9/1978 Soja et al. ..... 229/235
4,153,158 A 5/1979 Graser et al.
4,213,559 A 7/1980 Meyers
4,382,511 A * 5/1983 Hamelin et al. ..... 206/427
4,553,666 A 11/1985 Gullikson
4,778,059 A 10/1988 Martin et al.
4,905,837 A * 3/1990 Schuster et al. ..... 229/237
5,048,690 A 9/1991 Zimmerman
5,197,660 A 3/1993 Colling
5,332,150 A * 7/1994 Poirier ..... 229/235
5,413,276 A 5/1995 Sheffer
5,505,371 A 4/1996 O'Neill
5,524,815 A 6/1996 Sheffer
5,651,497 A * 7/1997 Ventura et al. ..... 229/235
5,826,728 A 10/1998 Sheffer
5,921,398 A * 7/1999 Carroll ..... 206/736
5,979,662 A 11/1999 Green
6,435,351 B1 * 8/2002 Gibb ..... 206/736
6,832,683 B2 * 12/2004 Boriani et al. ..... 229/235

FOREIGN PATENT DOCUMENTS

GB 2088830 A * 6/1982 ..... 229/235

* cited by examiner

*Primary Examiner*—Gary E. Elkins
(74) *Attorney, Agent, or Firm*—Carstens & Cahoon, LLP; Colin P. Cahoon; Chad E. Walter

(57) ABSTRACT

A shipping carton is converted to use as a display carton using perforated lines and precut openings that together define a line circumscribing the carton. At any location at which the perforated line crosses an edge of the carton of another perforated line, a precut opening provides a clean separation. Additionally, no section of the perforated lines parallels an adjacent fold line.

15 Claims, 4 Drawing Sheets

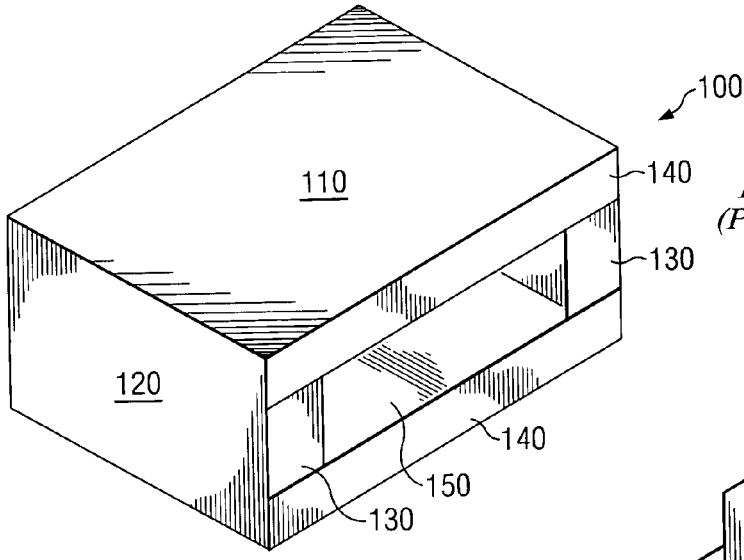
FIG. 1a
(PRIOR ART)
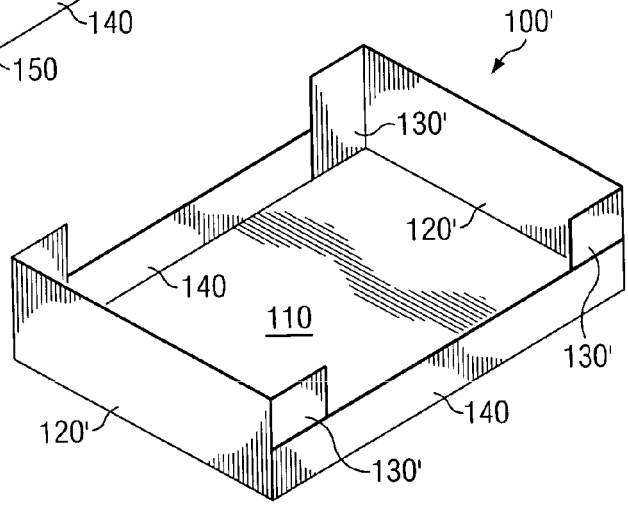
FIG. 1b
(IDEALIZED PRIOR ART)
FIG. 2a
(PRIOR ART)
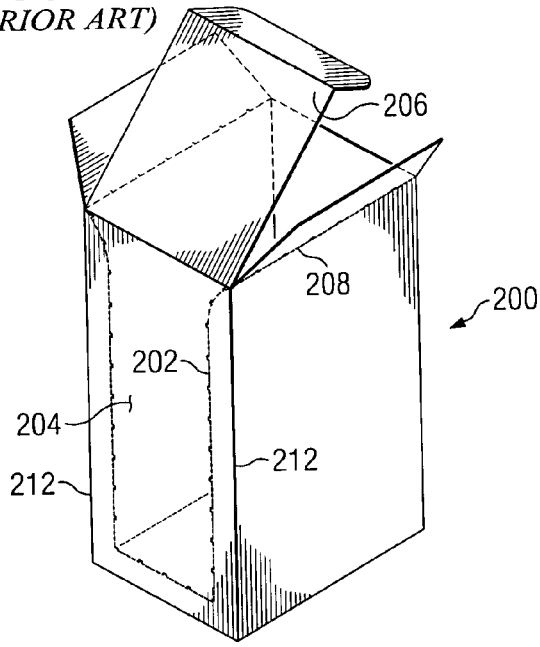
FIG. 2b
(PRIOR ART)
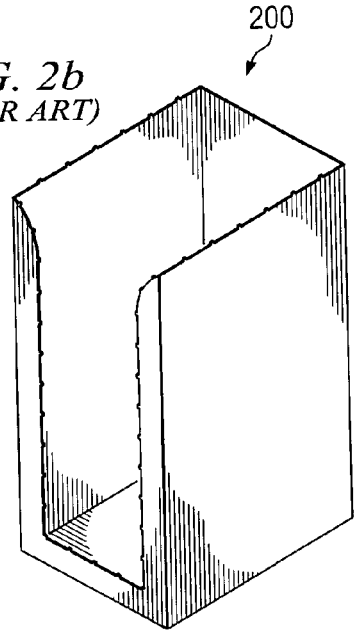

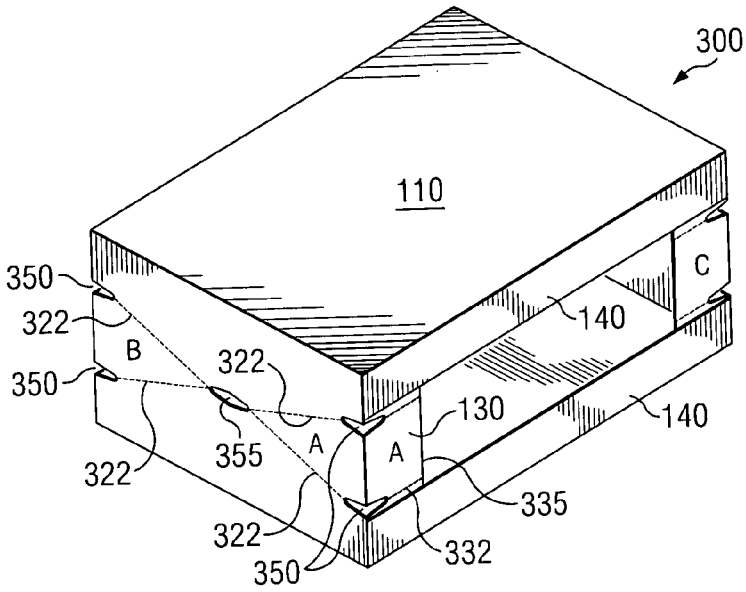
FIG. 3a
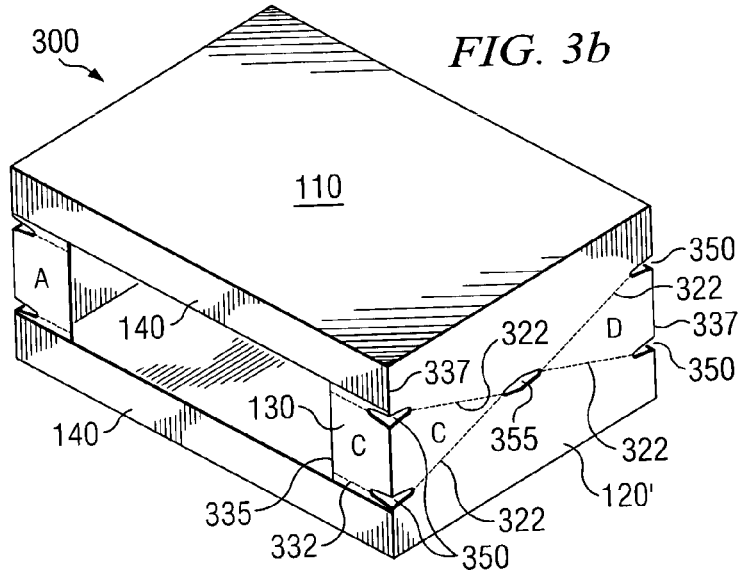
FIG. 3b
FIG. 3c
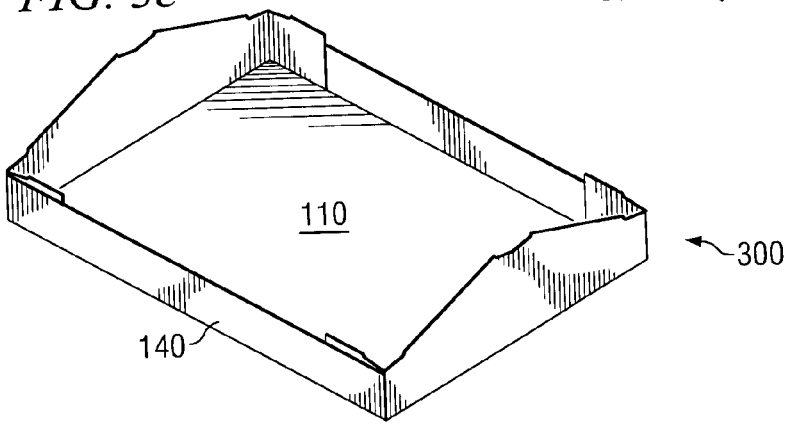

SHIPPING AND DISPLAY CARTON

BACKGROUND OF THE INVENTION

1. Technical Field

The present invention relates generally to a shipping and display carton. More specifically, the invention relates to a shipping carton, and a method of making a shipping carton, that is easily transformed into a display carton having neatly severed walls.

2. Description of Related Art

Millions of dollars are spent each year in packaging products for transportation from the manufacturer to the store. Rather than require these products to be removed from the container and individually placed on shelves, it has long been desirable to ship products in cartons that can quickly be converted to provide a display format. Because of the variety of products and their differing needs, many different types of shipping and display cartons have been made. Examples of combination shipping and display cartons can be found in U.S. Pat. No. 2,152,079 to Mott, U.S. Pat. No. 3,315,875 to Praetorius, U.S. Pat. No. 4,000,811 to Hardison et al., and U.S. Pat. No. 5,826,728 to Sheffer, to name a few, all of which are incorporated by reference. Each of these patents attempts to provide a convertible carton that will provide adequate protection for its contents during shipping, then transform into an aesthetic display carton.

By far the most common material used for shipping/display cartons is corrugated cardboard. This material is strong, lightweight, relatively inexpensive, and recyclable. When converting a corrugated shipping carton into a display carton, it would be desirable to have a carton that is easy to open, yet presents a pleasing appearance without inadvertent tears. Several means already exist that attempt to achieve this goal, although all have drawbacks. These drawbacks will be further explained using an exemplary carton, shown in FIG. 1*a*.

FIG. 1A shows a prior art design for a shipping and display carton 100 that has the shape of a rectangular prism measuring about 9¼×19½×9½ inches. The carton has four solid sides: top and bottom panels 110 and two end panels 120. Two short flaps 130 extend from the end panels 120 and two long flaps 140 extend from top and bottom panels 110. The two long flaps 140 are sized so that they do not meet to completely close the box; rather, all the flaps 130, 140 together frame an opening 150 in the carton, with overlapping flaps 130, 140 in each corner. Tape can be wrapped from the long flaps 140 to the ends 120 to seal and stabilize the carton, or the overlapping flaps 130, 140 can be glued or otherwise fastened together to seal the carton. This carton design is used for shipping lightweight containers of snack foods, such as chips. To convert the carton to display, the stocker removes the top half or two-thirds of the carton by cutting a line completely across each of the short flaps 130 and end panels 120. This creates a tray 150 having short edges that hold the product in place yet provide high visibility to consumers. FIG. 1B presents an idealized conversion to a display carton 100' with perfectly straight edges that neatly bisect panels 120 and 130 to create shortened sides 120' and 130'. The ability to make this neat of a transformation is desirable, but rarely obtainable. Often, the person stocking the product is in a hurry, so the actual cuts are rarely this straight or this neat. Further, the stocker must carry a knife and must take care not to cut the product during the process of converting the carton to display. In other carton designs, extra layers of cardboard are sometime included beneath the cut lines; these layers are used to protect the product during cutting, but add to the expense.

One alternative to cutting the carton is to use special tear strip tapes, such as those offered by 3M Corporation. These tapes can be used to make an easy-to-open carton that has a neat appearance, but they add significantly to the cost of the carton.

A third alternative is to provide perforations in the cardboard itself, so that sections of the carton can be quickly removed for display. This method is inexpensive, but has problems of its own. FIGS. 2*a* and 2*b* are taken from U.S. Pat. No. 3,315,875 to Praetorius and demonstrate a prior art method of turning a shipping carton 200 into a display carton 200'. Perforated lines 202 make a U-shape, defining a removable strip 204 that includes the larger flap 206 of the lid. Additional perforated lines 208 allow the smaller flaps 210 to be removed, creating the open display carton 200'. However, it can be difficult to obtain a clean tear. This is especially true at the edges of the carton, where the tear has to turn a corner. The strength of the cardboard is enhanced by the adjacent wall, so additional force is needed to tear. At the same time, the direction of the force needs to change abruptly; it is difficult to provide the extra force in a controllable manner. Too often tearing across a corner results in ragged edges that are less appealing. Additionally, the perforations create weakened sections of the carton that can accidentally tear, often when the package is being assembled. The carton of FIG. 2*a* is exemplary of this. When the blank is being folded to form the carton, care must be taken when making the vertical folds 212; otherwise the cardboard may accidentally fold along the weakened line of perforations 202, further weakening the line of perforations 202 and causing premature tearing. Likewise, the folds at the base of flaps 210 are weakened by the perforated lines 208. The pre-mature removal of the flaps 210 would leave a gap in the shipping carton 200. Because of these problems, this method has thus far proved to be inexpensive but less than ideal.

Consequently, it would be desirable to have a carton that is easily convertible from a shipping carton to a display carton, presents a neat, pleasing appearance for display, does not tear prematurely, requires no tools, and adds little or nothing to the cost of making the carton.

SUMMARY OF THE INVENTION

Difficulties with using perforated lines to remove sections of a carton are related to two problem areas: 1) having a line of perforations that parallel a nearby folding line and 2) the difficulty in tearing a perforated line that crosses an edge of the carton. In recognizing these problem areas, the invention sets as design criteria that a) no perforated line should parallel an adjacent fold line in the design and b) if a line of perforations crosses an edge of the carton, a precut opening should be provided at the juncture.

With these design criteria, it is possible to design a carton that meets all the desirable criteria discussed. The carton can be converted to display by removing one or more sections of cardboard bounded by perforated lines, using no tools. The difficulty in tearing around edges of the carton is removed by the pre-cut openings, permitting a neat, pleasing appearance. Because the perforated lines do not parallel adjacent fold lines, premature tearing is lessened or eliminated. Finally, this is a change in design that does not add to the cost of manufacturing the carton.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 1*a* depicts a prior art design for a shipping and display carton; FIG. 1*b* shows an idealized version of that same carton after conversion to display;

FIGS. 2*a* and 2*b* depict a prior art carton having perforations to aid in separating sections of the carton;

FIGS. 3*a* and 3*b* depict two views of a shipping and display carton according to a preferred embodiment of the invention, FIG. 3*c* shows the carton of FIGS. 3*a* and 3*b* after conversion to a display carton;

DETAILED DESCRIPTION

Figure 4:
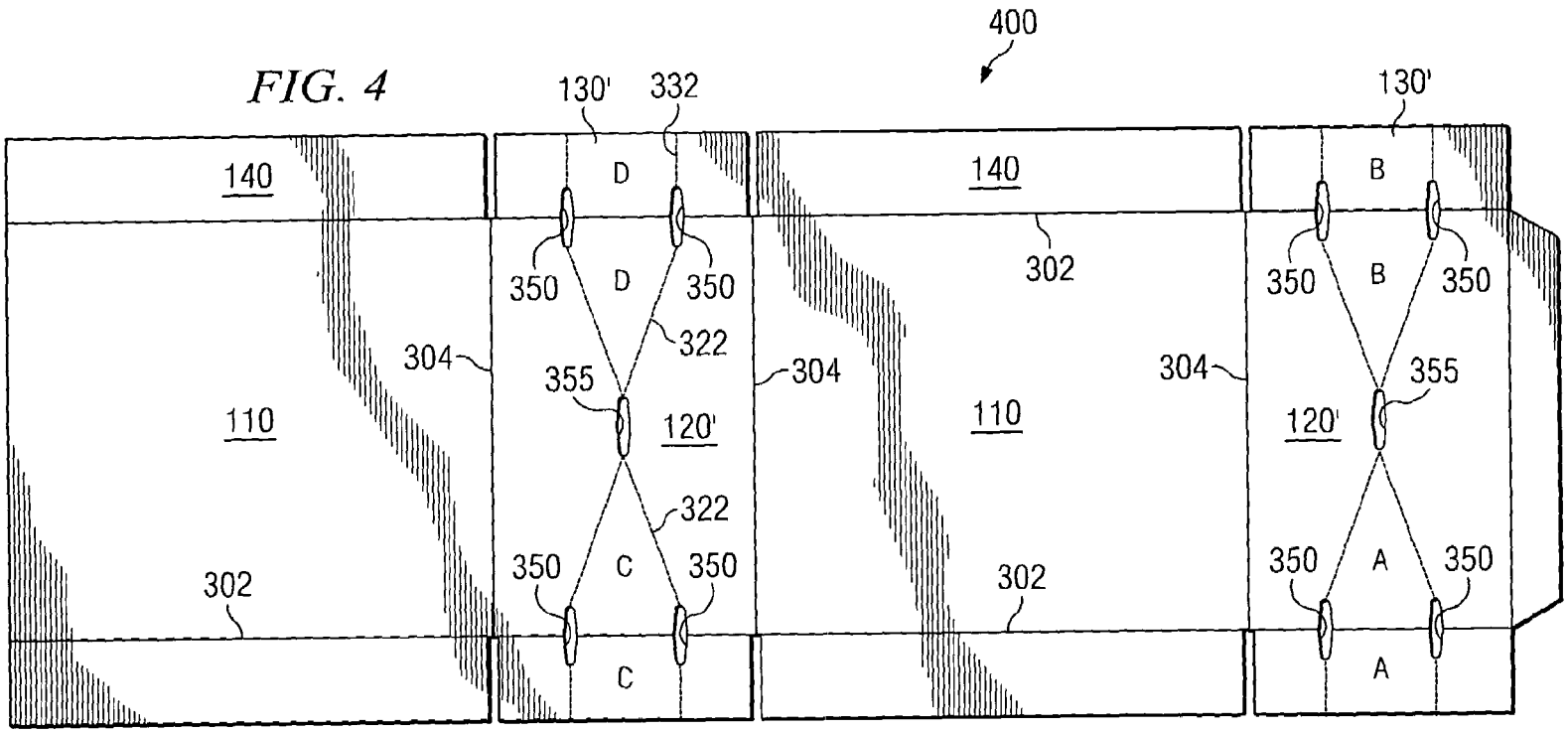
FIG. 4 depicts the layout for the shipping and display carton of FIGS. 3*a* and *b.

FIGS. 3*a* and 3*b* show a shipping and display carton according to a preferred embodiment of the invention. This carton 300 has the same basic shape as the prior art cartons 100 of FIGS. 1*a* and 1*b,* but uses the guidelines set forth above, namely that a) no perforated line should parallel an adjacent a fold line in the design and b) if a line of perforations crosses an edge of the carton, a precut opening should be provided at the juncture. Unless otherwise noted, identical element numbers used in common between drawings are to substantially similar elements in the drawings. As seen in FIGS. 3*a* and 3*b,* which are views from opposite ends of the carton, perforated line 332 runs from one edge 335 of the flap 130 almost to the edge 337 of the carton, where it terminates in a precut hole 350. The precut holes 350 wrap around the corner, so that there is no need to tear around a corner, the most common place for an accidental tear to happen. Perforated lines 322 run from each of four precut holes 350 to meet in another precut hole 355 in the center of the end panel 120. In this embodiment, the precut holes 350, 355 each have a width that ranges from ¼ to ⅝ inches and a length of 2¼ inches. A stocker need only grab the edge 335 of flap 130 and pull to quickly and cleanly separate section A from the rest of the carton. Four such moves and each of the corresponding sections B, C, D is removed, leaving the lower portion of the carton as a display tray 300', as seen in FIG. 3*c*.

In order to keep the tears along the perforated lines clean, the perforations and lands (spaces between the perforations) should both be in the range of ⅛ to ½ inches each. In the specific embodiment shown, the perforations are ¼ inch, while the lands are 3⁄16 inch. Additionally, at the beginning of each perforation line, the beginning perforation is longer, in the range of ½ to 1 inch in length, to be sure that the tear starts well. In the embodiment shown, the leading perforation is ¾ inch. These dimensions allow the cardboard to tear neatly, but provide enough strength to the carton that it will remain intact during shipping.

A blank for a corrugated cardboard box refers to the flat sheet of cardboard that has been cut into a necessary design and scored so that it will fold most easily along the desired lines. A blank is formed by a rotating die that can cut, score for fold lines, and perforate a sheet of corrugated cardboard in a single pass. FIG. 4 depicts a blank that can be assembled into the carton of FIG. 3*a*. Since all cuts and folding lines are made at the same time, the addition of the perforated lines and precut holes does not affect the cost of production. A manufacturer switching from making the box of FIG. 1*a* to the box of FIG. 3*a* would have to have changes made in the die used to make the boxes, but no additional costs beyond the die. As can be seen from FIG. 4, this is a purposefully simple design. Long fold lines 302 run the length of the pattern, between the flaps 130, 140, and the body 110, 120'. From this perspective, it is clear that none of the perforated lines parallel "adjacent" fold lines. For the purposes of this disclosure, fold lines are considered "adjacent" to perforated lines if they are not separated from the perforations by a cut or other fold line. Thus, perforation lines 332 run parallel to the fold lines 304, but these lines are not adjacent. Each fold line 304 terminates at a cut 306 and is separated from perforation lines 332 by a cut 306 and a fold line 302. Fold lines 302 are perpendicular to the perforation lines 232.

Figure 5:
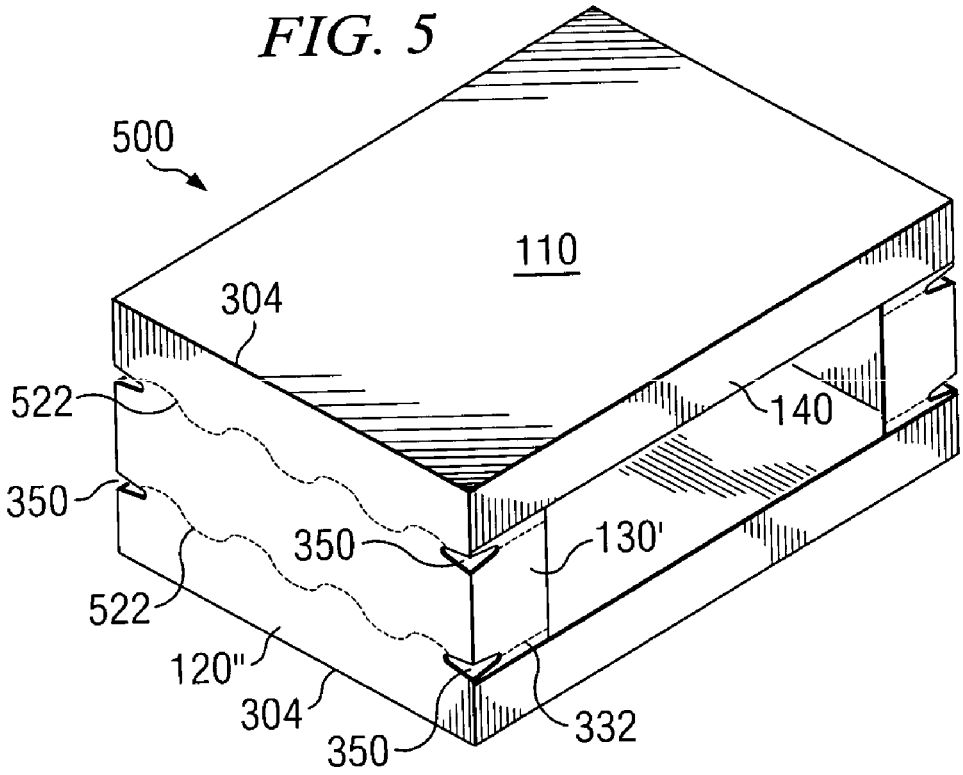
* and FIG. 5 depicts a shipping and display carton according to an alternate embodiment of the invention.

FIG. 5 shows a shipping and display carton 500 according to an alternate embodiment of the invention. This design has perforation lines 332 and precut holes 350 on flap 130', but the perforated lines 422 on end panel 120" curve up and down, similar to a sine wave. In such a manner, the perforated lines 422 are not parallel to the edges of the carton, which are formed at fold lines 304.

Two specific embodiments of the invention have been disclosed. However, one of ordinary skill in the art will recognize that one can modify the dimensions and particulars of the carton, as well as the specific design of the perforated lines, without straying from the inventive concept.

What is claimed is:

1. A carton for shipping and displaying a product, comprising:

a first, a second, a third, a fourth, a fifth, and a sixth side that together form a rectangular prism, wherein said first and said second sides are opposite each other, said third and said fourth sides are opposite each other, and said fifth and said sixth sides are opposite each other, and wherein said fifth and said sixth side are each formed from respective flaps extending respectively from said first, said second, said third and said fourth side, said flaps framing a first opening and a second opening in a central portion of said fifth and said sixth sides, respectively;

a plurality of perforated lines and precut openings (350) through portions of said third, fourth, fifth, and sixth sides, said plurality of perforated lines and precut openings (350), in conjunction with said first and said second openings, circumscribing said carton such that said first and said second sides can be completely separated from each other, wherein each of said perforated lines begins and ends at said first opening, said second opening, or one of said precut openings (350), and only said precut openings (350) cross an edge of said carton, further wherein none of said perforated lines (322) along an end panel parallels an adjacent fold, and further wherein none of said perforated lines (322) along an end panel parallels another perforated line (322) along said end panel; and wherein said pre-cut openings (350) comprise a width of between about ¼ inches and about ⅝ inches.

2. The carton of claim 1, wherein said perforated lines including four perforated lines within one or more of said end panels run from each of four pre-cut openings (350) to an end panel pre-cut opening (355).

3. The carton of claim 1, wherein said carton comprises corrugated cardboard.

4. The carton of claim 1, wherein said flaps extending from said first side and said second side are glued to respective ones of said flaps extending from said third side and said fourth side.

5. The carton of claim 1, wherein each of said perforation lines begins with a lead perforation having a length of ½ to 1 inch.

6. The carton of claim 1, wherein the perforations and lands of said perforations lines are ⅛ to ½ inches in *length*, with the exception of a lead *perforation*, which is *longer*.

7. A carton for shipping and displaying a product, comprising:

a blank that has been cut and folded to form a carton having the shape of a rectangular prism wherein two opposing sides are each formed using flaps foldably attached to the other four sides, further wherein these two opposing sides incompletely enclose the carton leaving a first and a second opposing opening in the center region of each of these two sides;

a plurality of perforated lines and precut openings in said blank that define an opening line by which opposing portions of said carton can be separated;

wherein said opening line crosses at least one edge of said carton;

wherein any portion of said opening line that crosses or meets said at least one edge of said carton is formed by one or more said precut openings; and wherein said pre-cut openings comprise a width of between about ¼ inches and about ⅝ inches.

8. The carton of claim 7, wherein said perforated lines including four perforated lines within one or more of said end panels run from each of four pre-cut openings (350) to an end panel pre-cut opening (355).

9. The carton of claim 7, further comprising two end panels, each end panel having a plurality of perforated lines (322), wherein no section of said plurality of perforated lines (322) parallels an adjacent fold.

10. The carton of claim 7, wherein said carton comprises corrugated cardboard.

11. The carton of claim 7, wherein each of said perforated lines begins with a lead perforation having a length of ½ to 1 inch.

12. The carton of claim 7, wherein the perforations and lands of said perforated lines are ⅛ to ½ inches in length, with the exception of a lead perforation, which is longer.

13. A carton for shipping and displaying a product, comprising:

a blank that has been cut and folded to form an enclosed cation having the shape of a rectangular prism;

a plurality of perforated lines (332) wherein each perforated line 332 terminates at a recut o enin (350) in said blank to define an opening line by which opposing portions of said carton can be separated, and wherein a plurality of perforated lines (322) form a cross pattern on each of one or more end panels (120') of the carton, further wherein the opening line crosses at least one edge (337) of the carton; and further wherein any portion of said opening line that crosses or meets said at least one edge (337) of said carton is formed by said one or more precut openings (350).

14. The cation of claim 13 further wherein an end panel precut opening (355) is formed at the intersection of each of the perforated lines which form a cross pattern.

15. The carton of claim 13 further wherein the perforated lines (322) form a cross pattern on both of said end panels (120') of the carton.

* * * * *

UNITED STATES PATENT AND TRADEMARK OFFICE

CERTIFICATE OF CORRECTION

PATENT NO. : 7,175,066 B2
APPLICATION NO. : 10/653742
DATED : February 13, 2007
INVENTOR(S) : Aditya Varanasa It is certified that error appears in the above-identified patent and that said Letters Patent is hereby corrected as shown below:

Column 5, Claim 6, lines 11 and 12, the words “length” “perforation” and “longer” should not be in italics.

Column 6, Claim 13, line 18, delete the word “o enin” and replace with -- opening --

Signed and Sealed this

Tenth Day of April, 2007

JON W. DUDAS
*Director of the United States Patent and Trademark Office*